US007775842B2

(12) United States Patent
Yamagami

(10) Patent No.: US 7,775,842 B2
(45) Date of Patent: Aug. 17, 2010

(54) CRIMPING STRUCTURE AND CRIMPING METHOD

(75) Inventor: Hidehisa Yamagami, Kanagawa (JP)

(73) Assignee: Tyco Electronics Japan G. K., Kanagawa (JP)

( * ) Notice: Subject to any disclaimer, the term of this patent is extended or adjusted under 35 U.S.C. 154(b) by 0 days.

(21) Appl. No.: 12/339,806

(22) Filed: Dec. 19, 2008

(65) Prior Publication Data

US 2009/0163088 A1 Jun. 25, 2009

(30) Foreign Application Priority Data

Dec. 21, 2007 (JP) ..... 2007-330125

(51) Int. Cl.
*H01R 4/10* (2006.01)

(52) U.S. Cl. ..... 439/877

(58) Field of Classification Search ..... 439/877, 439/879–882

See application file for complete search history.

(56) References Cited

U.S. PATENT DOCUMENTS 3,767,841 A * 10/1973 Anderson et al. ..... 174/84 C
3,857,995 A 12/1974 Wyrick
5,188,545 A * 2/1993 Hass et al. ..... 439/851
5,217,393 A * 6/1993 Del Negro et al. ..... 439/585
6,113,441 A * 9/2000 Fukase et al. ..... 439/877
6,976,889 B2 * 12/2005 Kuwayama et al. ..... 439/877
7,261,604 B2 * 8/2007 Brake et al. ..... 439/843
2005/0287875 A1 12/2005 Kojima
2007/0111613 A1 5/2007 Kumakura

FOREIGN PATENT DOCUMENTS

GB 2363525 A 12/2001
JP 2005-50736 A 2/2005

OTHER PUBLICATIONS

Search Report issued by the British Patent Office dated Apr. 8, 2009, 3 pages.

* cited by examiner

*Primary Examiner*—Gary F. Paumen
(74) *Attorney, Agent, or Firm*—Barley Snyder LLC

(57) ABSTRACT

A crimping structure for a conductor utilizes a crimp barrel, wherein the crimp barrel has a plurality of crimping parts that are provided continuously along an axial direction of the conductor. The crimp barrel is formed such that the widths of the plurality of crimping parts are different from each other in the expanded state, and the plurality of crimping parts are compressed to a uniform height along the axial direction.

4 Claims, 5 Drawing Sheets

FIG. 8D1
FIG. 8D2
(a)
(b)
(c)
Wa
α
1
20
21
22
40
41
42
43
44

CRIMPING STRUCTURE AND CRIMPING METHOD

CROSS-REFERENCE TO RELATED APPLICATIONS

This application claims the benefit of the filing date under 35 U.S.C. §119(a)-(d) of Japanese Patent Application No. 2007-330125, filed Dec. 21, 2007.

FIELD OF THE INVENTION

A crimp connection is widely used in connecting a terminal and a conductor, for instance a core wire of an electrical wire, because the connection can be performed without soldering. Therefore, the connection is suitable for mass production using automated equipment. When a terminal and a conductor are connected by crimping, the barrel around the conductor is compressed and deformed by a crimping tool. Furthermore, at the crimping part of the terminal to which the conductor is crimped, the conductor is placed in a state of compression at a specified compressibility (compression ratio) by the barrel. Here, the compressibility of the conductor by the barrel is determined based on the electrical characteristics and mechanical characteristics at the crimping part.

However, as is also disclosed in JP-A-2005-50736, the compression ratio of the conductor that is favorable for the electrical characteristics and mechanical characteristics do not generally match at the crimping part of the terminal. Here, the compression ration that is favorable for the electrical characteristics means the compressibility of the conductor at which the electrical resistance of the crimping part is at the minimum. Furthermore, the compressibility of the conductor that is favorable for the mechanical characteristics means the compressibility of the conductor at which the tensile strength of the crimping part is at the maximum. Incidentally, the compressibility of the conductor indicates the ratio of the cross-sectional area of the conductor prior to crimping to the cross-sectional area of the conductor following the crimping, and means that the higher the compressibility, the higher the amount of compression (same below). Moreover, the compressibility of the conductor crimped to an open crimp barrel is controlled by the height of the open crimp barrel compressed by a crimping tool (crimping height).

Specifically, as the compressibility of the conductor is increased at the crimping part of the terminal, the electrical resistance of the crimping part is reduced due to the breakage of an oxide film formed on the surface of the conductor or the like. However, if the compressibility of the conductor becomes excessively high, the electrical resistance of the crimping part is increased, resulting from a reduction in the cross-sectional area of the conductor at the crimping part.

Meanwhile, as the compressibility of the conductor is increased at the crimping part of the terminal, the tensile strength of the crimping part is increased. However, if the compressibility of the conductor becomes excessively high, the tensile strength of the crimping part is reduced, resulting from a reduction in the cross-sectional area of the conductor at the crimping part.

Furthermore, the compressibility of the conductor that is favorable for the electrical characteristics is generally higher than the compressibility of the conductor that is favorable for the mechanical characteristics.

An aluminum wire, in particular, has lower mechanical strength than a copper wire, and an oxide film tends to be formed on the surface thereof. Accordingly, in cases where an aluminum wire and a terminal are connected by crimping, the discrepancy between the compressibility of the conductor that is favorable for the electrical characteristics and the compressibility of the conductor that is favorable for the mechanical characteristics is increased compared to the case of a copper wire.

From the circumstances described above, when a conductor and a terminal are connected by crimping, there has been a problem in the past in that either the electrical characteristics or mechanical characteristics, or both, are not optimal at the crimping part of the terminal.

SUMMARY

The present invention is made in view of the technical problem described above, and it is an object of the present invention, among others, to provide a crimping structure and a crimping method that can optimize both the electrical characteristics and mechanical characteristics at the crimping part of a terminal.

A crimping structure for a conductor is provided using a crimp barrel, wherein the crimp barrel has a plurality of crimping parts that are provided continuously along an axial direction of the conductor. The crimp barrel is formed such that the widths of the plurality of crimping parts are different from each other in the expanded state, and the plurality of crimping parts are all compressed to a uniform height along the axial direction.

It is further an object of the invention to provide a crimping method for a conductor using a crimp barrel, wherein the crimp barrel has a first crimping part and a second crimping part that are provided continuously along the axial direction of the conductor. The second crimping part is formed toward the tip end of the conductor relative to the first crimping part, and the open crimp barrel is formed such that the width of the second crimping part is greater than the width of the first crimping part in the expanded state. The first crimping part and the second crimping part are both compressed to a uniform height along the axial direction of the conductor by a paired anvil and crimper.

BRIEF DESCRIPTION OF THE DRAWINGS

The invention will be explained in greater detail in the following with reference to embodiments, referring to the appended drawings, in which:

FIGS. 8*a*-8*d*2 are model diagrams showing progressive states during the crimping of conductors to the crimping part of the female-type terminal shown in FIG. 1 using a crimping tool.

DETAILED DESCRIPTION OF THE EMBODIMENT(S)

The invention will now be described in greater detail. Reference will now be made in detail to the embodiments of the present invention, which are illustrated in the accompanying drawings.

Figure 1:
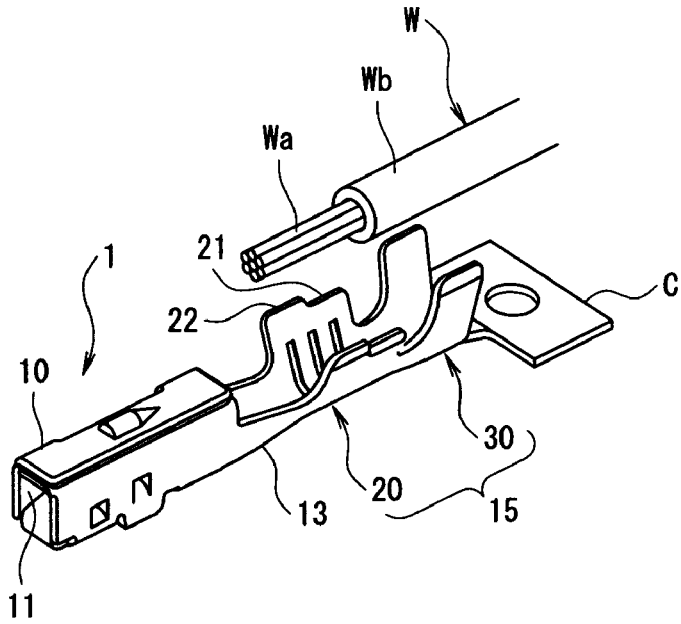
FIG. 1 is a perspective view of a female-type terminal according to an embodiment of the present invention, shown together with covered electrical conductors.
Figure 2:
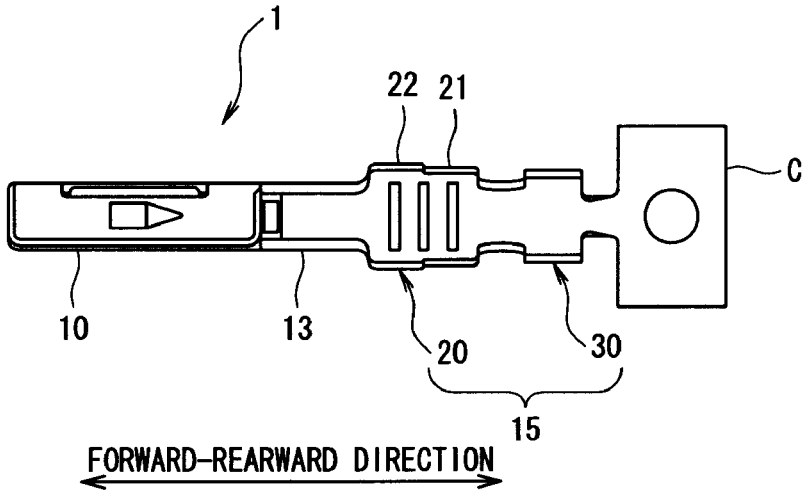
FIG. 2 is a plan view of the female-type terminal shown in FIG. 1.
Figure 3:
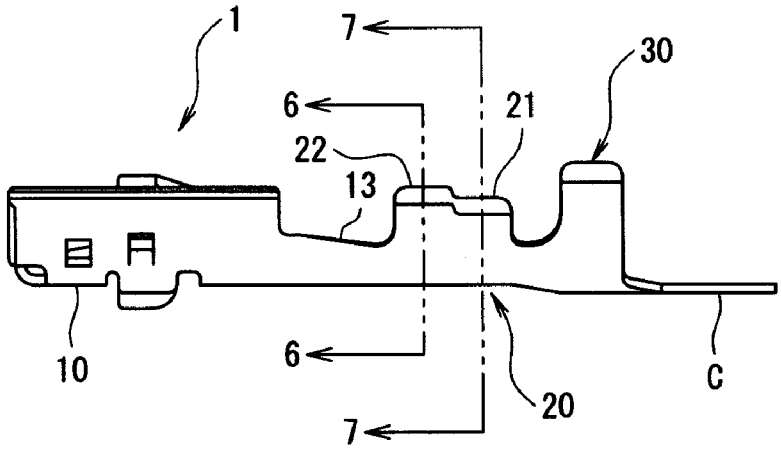
FIG. 3 is a side view of the female-type terminal shown in FIG. 1.
Figure 4:
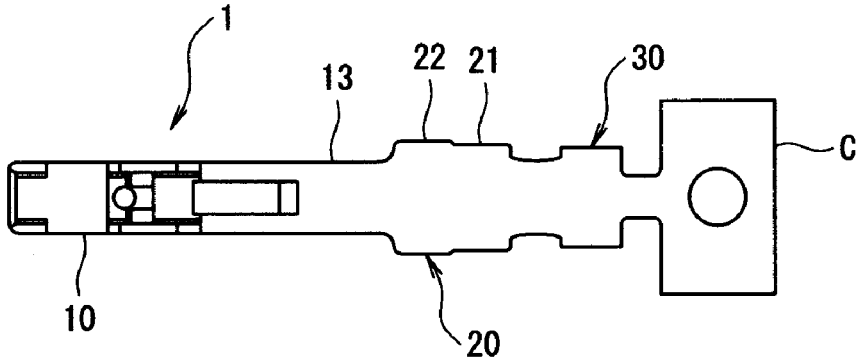
FIG. 4 is a bottom view of the female-type terminal shown in FIG. 1.
Figure 5:
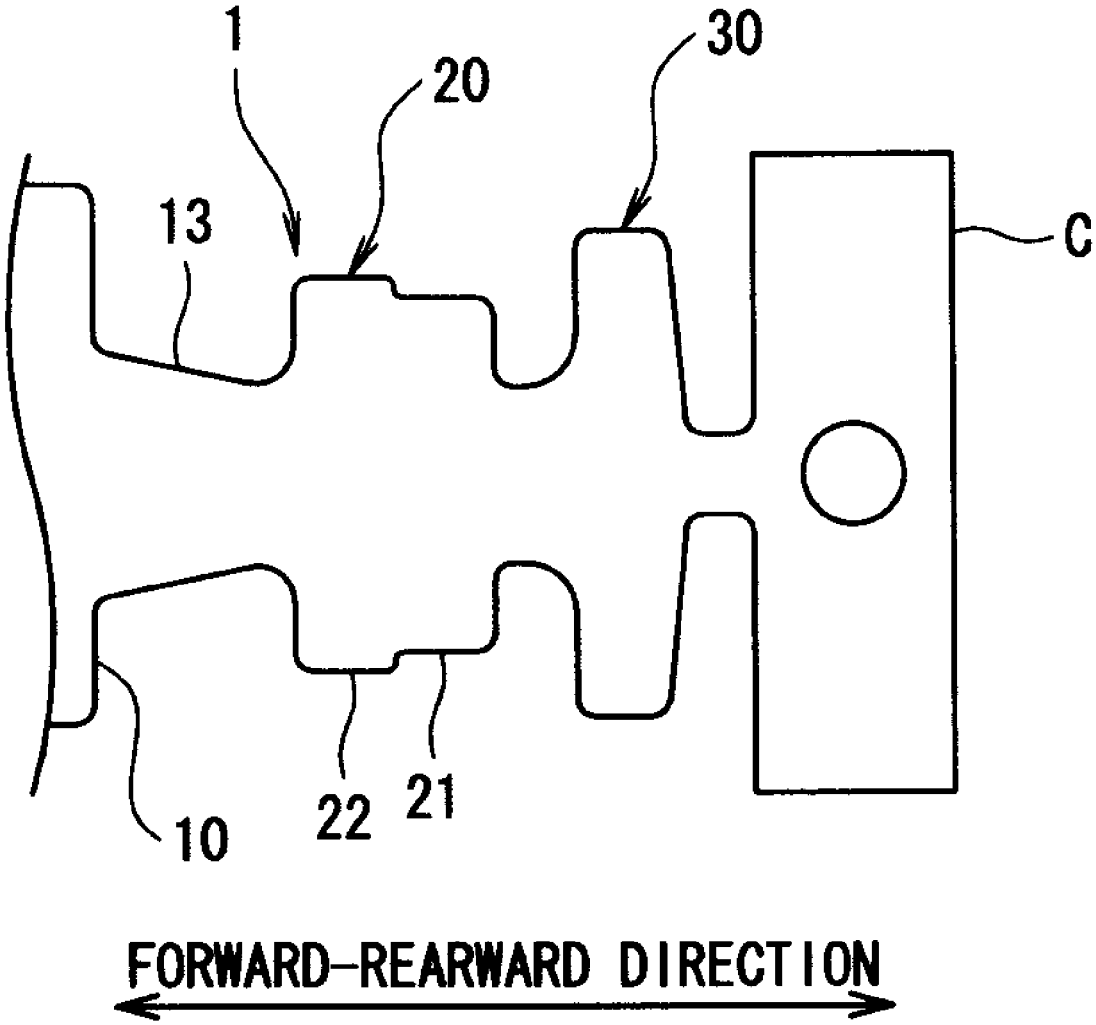
FIG. 5 is a plan view showing the expanded state of the female-type terminal shown in FIG. 1.
Figure 6:
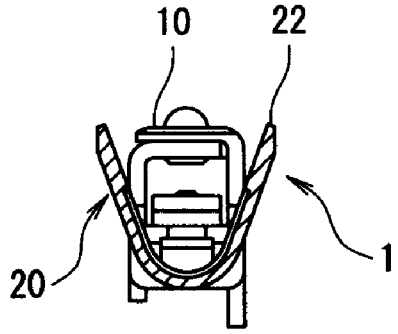
FIG. 6 is a sectional view along line 6-6 in FIG. 3.
Figure 7:
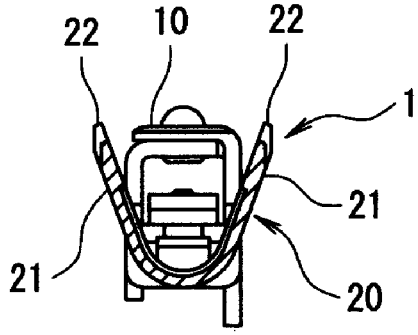
FIG. 7 is a sectional view along line 7-7 in FIG. 3.

FIG. 1 is a perspective view of a female-type terminal according to an embodiment of the present invention, shown together with covered electrical conductors. FIG. 2 is a plan view of the female-type terminal shown in FIG. 1. FIG. 3 is a side view of the female-type terminal shown in FIG. 1. FIG. 4 is a bottom view of the female-type terminal shown in FIG. 1. FIG. 5 is a plan view showing the expanded state of the female-type terminal shown in FIG. 1. FIG. 6 is a sectional view along line 6-6 in FIG. 3. FIG. 7 is a sectional view along line 7-7 in FIG. 3. FIG. 8 is a model diagram showing states during the crimping of conductors to the crimping part of the female-type terminal shown in FIG. 1 using a crimping tool. Note that in FIGS. 1 through 7, the direction in which the conductors Wa of covered electrical conductors W extend is designated as the forward-rearward direction, with the side of the conductors Wa toward a mating contact (toward a receptacle 10) being referred to as forward.

The crimping structure of the present invention can be applied to various terminals having an open crimp barrel that crimps a conductor. Furthermore, the crimping structure of the present invention can be applied to an open crimp barrel that crimps a conductor.

An open crimp barrel is widely used as the crimping part of a terminal, because it is suitable for work by means of automated equipment. Here, because the wiring (wire harness) of an automobile comprises numerous electrical conductors, automated equipment-based work must inevitably be presumed. Moreover, in the wiring of an automobile, it is necessary to increase the holding force by installing an insulation barrel in order to prevent damage to the core conductors (wires) caused by vibration accompanying driving to the maximum extent possible. Accordingly, an open crimp barrel is utilized particularly as a terminal for automotive use.

In the present embodiment, a case will be described in which the crimping structure of the present invention is applied to a female-type terminal used for an electrical connector.

The female-type terminal 1, shown in FIGS. 1 through 4, has a base 13, a receptacle 10 that extends forward from the base 13, and a main barrel 15 that extends rearward from the base 13. The female-type terminal 1 is formed by bending a stamped metal plate. The female-type terminal 1, which is in a state prior to the bending work (hereinafter referred to as "expanded state"), is a flat plate form as shown in FIG. 5.

The receptacle 10 is formed by bending a stamped metal plate into a box shape as shown in FIGS. 1 through 4. The receptacle 10 has a terminal insertion opening 11 into which the male-type terminal (not shown in the figures) of a mating connector is inserted. Furthermore, the receptacle 10 is electrically connected to the male-type terminal that is inserted into the terminal insertion opening 11.

The main barrel 15 is formed as an open crimp barrel, and crimps the covered electrical conductors Wa, of cable W. The main barrel 15 has a conductor barrel 20 that crimps the conductors Wa, and an insulation barrel 30 that crimps the insulating covering Wb of the cable W.

As is shown in FIGS. 6 and 7, the conductor barrel 20 is formed by bending a stamped metal plate such that the section as seen from the forward-rearward direction (the left-right direction in FIGS. 2 through 4 and the depth direction in FIGS. 6 and 7) is in the shape of the letter U. Furthermore, the conductor barrel 20 is composed of a first crimping part 21 and a second crimping part 22 that are formed in a continuous manner along the forward-rearward direction.

The second crimping part 22 is formed toward the tip ends of the conductors Wa relative to the first crimping part 21. As is shown in FIG. 5, the conductor barrel 20 of the female-type terminal 1 is formed such that the width of the first crimping part 21 and the width of the second crimping part 22 are different from each other in the expanded state. In the present embodiment, the conductor barrel 20 of the female-type terminal 1 is formed such that the width of the second crimping part 22 is greater than the width of the first crimping part 21 in the expanded state. The conductor barrel 20 of the female-type terminal 1 is formed such that the two sides of the first crimping part 21 in the direction of width (vertical direction in FIG. 5) extend parallel to each other along the forward-rearward direction in the expanded state. Moreover, the conductor barrel 20 of the female-type terminal 1 is formed such that the two sides of the second crimping part 22 in the direction of width extend parallel to each other along the forward-rearward direction in the expanded state. That is, the conductor barrel 20 of the female-type terminal 1 is formed such that each of the two sides of the conductor barrel 20 in the direction of width creates a staircase shape along the forward-rearward direction in the expanded state, with one side of the first crimping part 21 in the direction of width and one side of the second crimping part 22 in the direction of width. Consequently, as is shown in FIG. 7, the conductor barrel 20 of the female-type terminal 1, formed by the bending work, is such that the respective end portions in the direction of width of the second crimping part 22 protrude diagonally upward, relative to the respective end portions in the direction of width of the first crimping part 21.

The insulation barrel 30 is formed such that the section as seen from the forward-rearward direction is in the shape of the letter U as shown in FIG. 1.

Furthermore, FIGS. 1 through 5 show a state in which the female-type terminal 1 is connected to a contact carrier C, but the female-type terminal 1 is cut off from the contact carrier C following working.

Next, a crimping tool 40 for crimping the conductor barrel 20 of the female-type terminal 1 to the conductors Wa of the covered cable W will be described.

As is shown in FIGS. 8*a*-8*d*2, the crimping tool 40 comprises an anvil 41 that positions and holds the female-type terminal 1, and a crimper 42 that compresses, from above, the conductor barrel 20 of the female-type terminal 1 held by the anvil 41. The compression surfaces of the anvil 41 and crimper 42 that contact the conductor barrel 20 may be flat over the forward-rearward direction of the female-type terminal 1.

A placement groove 43 in which the female-type terminal 1 is installed is formed in the upper surface of the anvil 41. The placement groove 43 has a U-shaped section that fits the back surface of the conductor barrel 20. The placement groove 43 is formed along the forward-rearward direction. Note that the forward-rearward direction is the depth direction in FIG. 8. Furthermore, the anvil 41 holds, from below, the bottom surface of the conductor barrel 20 of the female-type terminal 1 installed in the placement groove 43.

The crimper 42 is designed to be movable in a receiving or separating direction with respect to the anvil 41, which is installed in a fixed manner. In the present embodiment, the crimper 42 can move in the vertical direction. A compression groove 44, which mutually faces a placement groove 43 in the anvil 41, is formed in the undersurface of the crimper 42, as shown in FIGS. 8*a*-8*d*2. The compression groove 44 extends parallel to the placement groove 43 in the anvil 41. The compression groove 44 is formed such that the section as seen, from the forward-rearward direction, is in the shape of the letter M. Moreover, the compression groove 44 compresses the conductor barrel 20 of the female-type terminal 1, having been positioned in the placement groove 43 of the anvil 41.

Next, a method for crimping the conductor barrel 20 of the female-type terminal 1 to the conductors Wa of the covered electrical conductors W will be described. Here, when the covered cable W is positioned in the main barrel 15 of the female-type terminal 1, the crimping of the conductors Wa to the conductor barrel 20 and the crimping of the insulating covering Wb to the insulation barrel 30 are performed at the same time. In the present embodiment, the crimping of the insulating covering Wb to the insulation barrel 30 will be omitted from the description. Furthermore, prior to the crimping step, the insulating covering Wb, at the tip end portions of the cable W, is removed in advance, so that the conductors Wa are exposed.

Figures 8A, 8B, 8C:
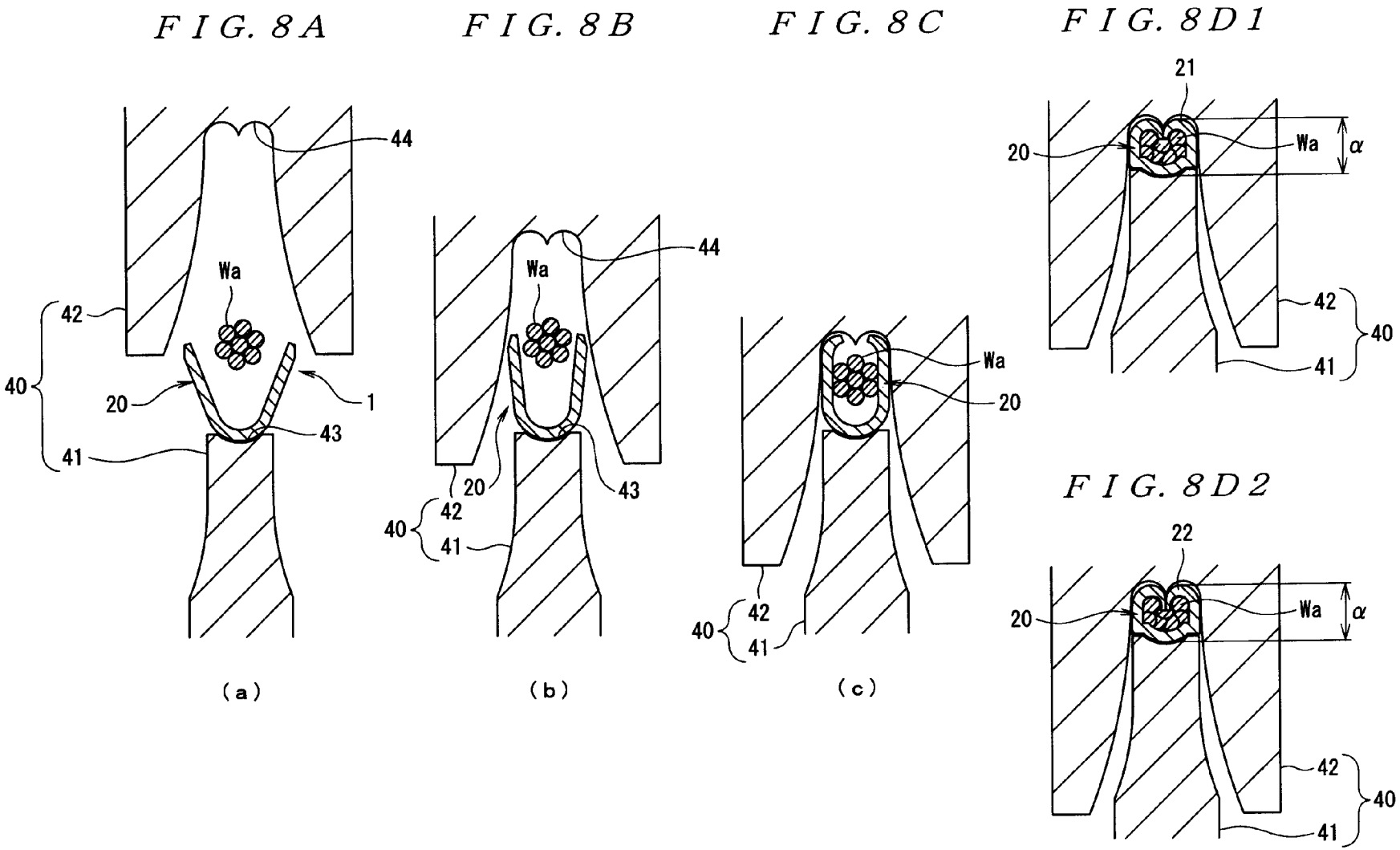

FIG. 8*a* shows the crimping tool 40 in the initial state of crimping, wherein the crimper 42 is positioned above the anvil 41.

When the conductor barrel 20 of the female-type terminal 1 is to be crimped to the conductors Wa of the cable W, the female-type terminal 1 is first positioned in the placement groove 43 of the anvil 41, the crimping tool 40 set in the initial state. Furthermore, the conductors Wa are inserted into the conductor barrel 20 of the female-type terminal 1.

As shown in FIG. 8*b*, the crimper 42 is lowered toward the anvil 41, thus initiating the compressive deformation of the conductor barrel 20 by means of the anvil 41 and crimper 42. Here, the first crimping part 21 and the second crimping part 22 of the conductor barrel 20 are compressively deformed simultaneously by the paired anvil 41 and crimper 42. When the lowering of the crimper 42 is initiated, both end portions of the first crimping part 21 and the second crimping part 22 of the conductor barrel 20 are respectively deformed along the inner surfaces of the compression groove 44 of the anvil 41.

FIG. 8*c* shows further lowering of the crimper 42. Both end portions of the first crimping part 21 and both end portions in the direction of width of the second crimping part 22 of the conductor barrel 20 are respectively bent downward along the bottom surface of the compression groove 44 in the crimper 42.

As the crimper 42 is lowered even further, the end portions of first crimping part 21 and second crimping part 22 are respectively deformed so as to surround the conductors Wa. Moreover, both end portions of the first crimping part 21 and the second crimping part 22 of the conductor barrel 20 compress, in the direction of width, the cable W inserted into the conductor barrel 20. Then, as a result of the first crimping part 21 and second crimping part 22 compressing the cable W, which has been inserted into the conductor barrel 20, the gap between the conductors Wa and the gap between the conductor barrel 20 and the conductors Wa is closed.

Subsequently, when the conductor barrel 20 is compressed to a specified height (crimping height) a, as shown in FIGS. 8*d*1 and 8*d*2, by lowering the crimper 42, the crimping of the conductor barrel 20 to the conductors Wa is completed. Here, the first crimping part 21 and the second crimping part 22 of the conductor barrel 20 are both compressed to the uniform height α, along the forward-rearward direction.

Specifically, the first crimping part 21 and second crimping part 22, which have different widths from each other in the expanded state, are compressed simultaneously (in a single compression step) until both of these crimping parts are made to have the same height α by the paired anvil 41 and crimper 42. In addition, the conductor barrel 20 of the female-type terminal 1 is formed such that the width of the second crimping part 22 is greater than the width of the first crimping part 21 in the expanded state.

When the first crimping part 21 and second crimping part 22 are crimped to the uniform height α along the forward-rearward direction, consequently, the amount of compression by the end portions of the second crimping part 22 on the conductors Wa becomes greater than the amount of compression applied to the conductors Wa by the end portions of the first crimping part 21. Accordingly, in the conductor barrel 20 that has crimped the conductors Wa (i.e., in the crimping structure), the amount of compression of the conductors Wa by the second crimping part 22 is greater than the amount of compression of the conductors Wa by the first crimping part 21.

Furthermore, the width of the first crimping part 21 of the female-type terminal 1 in the expanded state is set at a dimension at which the conductors Wa are compressed at a specified compression ratio that makes the mechanical characteristics optimal when the first crimping part 21 is compressed to the specified height α. Moreover, the width of the second crimping part 22 of the female-type terminal 1 in the expanded state is set at a dimension at which the conductors Wa are compressed at a specified compression ratio that makes the electrical characteristics optimal, when the second crimping part 22 is compressed to the specified height α.

As a result, the compressibility of the conductors Wa at which the electrical characteristics are optimal can be obtained at the second crimping part 22 toward the tip ends of the conductors Wa, and the compressibility of the conductors Wa at which the mechanical characteristics are optimal can be obtained at the first crimping part 21 toward the insulating covering Wb of the conductors Wa. That is, the first crimping part 21 is crimped to the conductors Wa such that the mechanical characteristics are optimal, and the second crimping part 22 is crimped to the conductors Wa such that the electrical characteristics are optimal.

Accordingly, it is possible to optimize both the electrical characteristics and mechanical characteristics of the conductors Wa at the crimping parts 21 and 22.

Here, as a conventional method for optimizing both the electrical characteristics and mechanical characteristics at the crimping part of a terminal, there is a method in which two mutually independent conductor barrels are provided on a single terminal. Furthermore, the two conductor barrels are respectively compressed to mutually different heights by different anvils and crimpers. In this conventional method, however, the heights to which the conductor barrels are compressed must be controlled for each conductor barrel when the terminal is crimped to the conductors. Accordingly, this conventional method has the problem of increased control man-hours during the crimping of the terminal to the conductors. In the method of the present embodiment, on the other hand, it is only sufficient if the first crimping part 21 and the second crimping part 22 are both compressed to the uniform height α along the forward-rearward direction by the paired anvil 41 and crimper 42 when the conductor barrel 20 is crimped to the conductors Wa. That is, the crimping work of the conductor barrel 20 as a whole can be performed solely by the paired anvil 41 and crimper 42 when the conductor barrel 20 is crimped to the conductors Wa. Therefore, there is no increase in the control man-hours during crimping.

An embodiment of the present invention has been described above. However, it is possible to make various alterations in the embodiment described above.

For example, the present embodiment has a construction in which the conductor barrel 20 is composed of the first crimping part 21 and second crimping part 22. However, it would also be possible to use a construction in which the conductor barrel 20 has three or more crimping parts that are provided continuously along the forward-rearward direction. In this case, the conductor barrel 20 of the female-type terminal 1 is formed such that the widths of the three or more crimping parts are different from each other in the expanded state. Moreover, the three or more crimping parts are all compressed to a uniform height along the forward-rearward direction. Consequently, it is possible to achieve mutually different rates of compressibility of the conductors Wa can be obtained by the three or more crimping parts.

Furthermore, in the present embodiment, the conductor barrel 20 of the female-type terminal 1 is formed such that the width of the second crimping part 22 is greater than the width of the first crimping part 21 in the expanded state. Because of this, the amount of compression of the conductors Wa by the second crimping part 22 is greater than the amount of compression of the conductors Wa by the first crimping part 21 in the conductor barrel 20 that has crimped the conductors Wa. However, the conductor barrel 20 of the female-type terminal 1 may also be formed such that the width of the second crimping part 22 is smaller than the width of the first crimping part 21 in the expanded state. This will make the amount of compression of the conductors Wa by the second crimping part 22 smaller than the amount of compression of the conductors Wa by the first crimping part 21 in the conductor barrel 20 that has crimped the conductors Wa.

In addition, in the present embodiment, the crimping structure of the present invention is applied to the female-type terminal 1 for an electrical connector. However, the crimping structure of the present invention can also be applied to various crimping terminals such as male-type terminals and crimping terminals that are not equipped with any insulation grip.

The foregoing illustrates some of the possibilities for practicing the invention. Many other implementations are possible within the scope and spirit of the invention. It is, therefore, intended that the foregoing description be regarded as illustrative rather than limiting, and that the scope of the invention is given by the appended claims together with their full range of equivalents. Additional implementations may be created by combining, deleting, modifying, or supplementing various features of the disclosed implementations.

What is claimed is:

1. A crimping structure for a conductor comprising:

a crimp barrel formed in a U shape; and a plurality of crimping parts integrally formed together and located on the crimp barrel continuously along an axial direction of the conductor, widths of the crimping parts being different from each other and creating a staircase shape of the barrel along the forward-rearward direction in an expanded state; and the crimping parts of differing widths being compressed to a uniform height along the axial direction.

2. A crimping structure for a conductor comprising:

a crimp barrel formed in a U shape; and a first crimping part and a second crimping part integrally formed together and located on the crimp barrel along an axial direction of the conductor, the second crimping part being formed toward a tip end of the conductor, a width of the second crimping part being greater than a width of the first crimping part and creating a staircase shape of the barrel along the forward-rearward direction in an expanded state, and the first crimping part and the second crimping part both being compressed to a uniform height along the axial direction.

3. A crimping method for a conductor comprising:

providing a crimp barrel in a U shape and having a plurality of crimping parts integrally formed together and located on the crimp barrel continuously along an axial direction of the conductor;

forming the crimp barrel such that widths of the crimping parts are different from each other and create a staircase shape of the barrel along the forward-rearward direction in an expanded state; and compressing the crimping parts to a uniform height along the axial direction by a paired anvil and crimper.

4. A crimping method for a conductor comprising the steps:

providing a first crimping part and a second crimping part integrally formed together and located on a crimp barrel along an axial direction of the conductor, the crimp barrel formed in a U shape;

forming the second crimping part toward a tip end of the conductor;

forming the crimp barrel such that a width of the second crimping part is greater than a width of the first crimping part creating a staircase shape of the barrel along the forward-rearward direction in an expanded state; and compressing the first crimping part and the second crimping part to a uniform height along the axial direction by a paired anvil and crimper.

* * * * *

UNITED STATES PATENT AND TRADEMARK OFFICE

CERTIFICATE OF CORRECTION

PATENT NO. : 7,775,842 B2
APPLICATION NO. : 12/339806
DATED : August 17, 2010
INVENTOR(S) : Hidehisa Yamagami It is certified that error appears in the above-identified patent and that said Letters Patent is hereby corrected as shown below:

In column 8, line 6 "together and located" should read -- together such that a distal end of one of the crimping parts extends from the other crimping part, the crimping parts being located --.

In column 8, line 17 "together and located" should read -- together such that a distal end of one of the crimping parts extends from the other crimping part, the crimping parts being located --.

In column 8, line 28 "together and located" should read -- together such that a distal end of one of the crimping parts extends from the other crimping part, the crimping parts being located --.

In column 8, line 39 "together and located" should read -- together such that a distal end of one of the crimping parts extends from the other crimping part, the crimping parts being located --.

Signed and Sealed this

Twenty-third Day of November, 2010

David J. Kappos

David J. Kappos
*Director of the United States Patent and Trademark Office*